US006029752A

United States Patent [19]

Young

[11] Patent Number: 6,029,752

[45] Date of Patent: Feb. 29, 2000

[54] AUTOMATIC LEVELING SYSTEM FOR A GRADING BLADE

[76] Inventor: Kevin Young, 7580 Hoeffner La., Ft. Pierce, Fla. 34995

[21] Appl. No.: 09/152,389

[22] Filed: Sep. 14, 1998

Related U.S. Application Data

[60] Provisional application No. 60/066,409, Nov. 24, 1997.

[51] Int. Cl.[7] ..... E02F 3/76

[52] U.S. Cl. ..... 172/4.5; 172/445.1

[58] Field of Search ..... 172/4, 4.5, 7, 812, 172/818, 445.1, 449, 779, 780, 799, 413, 417, 448, 451, 484

[56] References Cited

U.S. PATENT DOCUMENTS 4,244,123 1/1981 Lazure et al. ..... 37/193
4,299,290 11/1981 Nunes, Jr. ..... 172/4.5
5,267,517 12/1993 Jones ..... 172/548 X

*Primary Examiner*—Robert E. Pezzuto
*Attorney, Agent, or Firm*—Kevin Redmond

[57] ABSTRACT

A hitching system for a tractor or similar vehicle which includes a parallelogram of four rigid members rotatably connected together at the ends of each of the members and in which the members are arranged to provide at least one member which is positioned vertically and moves essentially in the vertical direction despite variations in the surface of the terrain and the height to which the movable vertically positioned member is adjusted. This movable, vertically positioned member is connected to a blade, such as a box blade, to cause the blade to be held with its lower surface generally parallel to the desired final grade of the terrain. The blade is adjusted in the vertical direction as necessary to level the surface of the terrain by a hydraulic cylinder. A laser guidance system is included in a preferred embodiment to control this hydraulic cylinder and the height of the blade with respect to the terrain.

6 Claims, 2 Drawing Sheets

AUTOMATIC LEVELING SYSTEM FOR A GRADING BLADE

This application claims the benefit of U.S. Provisional No. 60/066,409 filed Nov. 24, 1997.

BACKGROUND

1. Field

The present invention relates to devices for grading terrain and more particularly to the improved control of tractor drawn blades, such as box blades.

2. Prior Art

There have been a number of prior art devices designed to produce level terrain by using different blades and different methods of attachment of the blade to the tractor. In particular, different methods have been used to actuate the blade to compensate for variations in the initial terrain. Roughness of the terrain and especially high and low areas in the initial terrain typically cause the tractor and the attached blade to move in a vertical and sometimes horizontal direction, making level grading difficult. Constant adjustments of the controls by the tractor operator are usually required to achieve the desired level terrain. To more clearly illustrate this problem, three prior art inventions designed to grade or contour terrain are listed below along with the difficulties encountered with each of these inventions.

Generally box blade are connected to a tractor by way of what is referred to as a three point hitch such as hitch 2 shown in FIG. 1. The box blade 3 is connected to the tractor 1 by the hitch 2. This hitch has three support members which extend from the tractor to the box blade. If it is necessary to raise or lower the box blade, an hydraulic cylinder 4 connected between the tractor and the hitch raises and lowers the hitch, but the hitch rotates about a point 2A and can place the lower surface of the blade 3A unintentionally at a pitch angle with the horizontal plane, as shown by the position of the blade shown in the dashed lines of FIG. 2. The pitch angle has been exaggerated in this Figure for illustrative purposes, but the problem it produces is real and significant even though the actual pitch angles may be small. This unintentionally produced pitch angle requires the tractor operator to supply constant corrections to compensate. In general, the production of the unintentional pitch angle makes grading for the operator more difficult and time consuming.

U.S. Pat. No. 4,299,290 employs a set of wheels at the rear of a blade to aid in supporting the blade above the existing terrain. Hydraulic systems are used to further adjust the front and rear of the blade above the terrain.

The problem encountered with this arrangement is the hydraulic system used to control the blade must be continuously controlled manually. A particular position for the box blade cannot be simply "found" and "locked" in place. It is difficult to hold the lower surface of the box blade in the horizontal plane and also hold it at a particular height of say one-fourth of an inch above the surface of the terrain.

This system also suffers from the effects of an initially rough terrain because the blade does not instantaneously level the terrain before the trailing wheels pass over it. Consequently, the wheels follow the initial contours of the terrain and tend to move the blade away from its desired position.

The blade shown in this patent is a box blade which includes sides and a partially open bottom that takes on soil taken when passing over high spots and empties soil when passing over low spots. These filling and emptying actions take place as long as the blade is held at a desired elevation and the lower surface of the blade remains generally parallel with the horizon plane so that the blade picks up the correct amount of fill and unloads it where it is needed. To keep the lower surface of the blade in this position is difficult because the movement of the wheels of both the tractor and the wheels attached to the blade can throw the blade off from its desired position. Also, the hydraulic systems used to correct the position of the blade does not ordinarily include controls designed to automatically compensate for such problems. As a result, the operator must continually adjust the controls to compensate for these problems. This system does not inherently tend to keep the lower surface of the box blade in a generally horizontal position, which would greatly reduce the complexity of control. An additional problem is the wheels at the rear of the blade prevent the tractor from coming close to a wall. This prevents this arrangement from being applied to complete many areas and thereby generally reduces its usefulness.

U.S. Pat. No. 4,919,212 shows a method of connecting a dozer blade to the front of a tractor. There are two hydraulic controls used to position the blade; however, movement of one of the controls tips the blade either to the right and left and the other moves the blade up and down. There is no single control to keep the blade in the same relative position with respect to the terrain when the tractor runs over a high spot in the terrain. The lower surface of the blade is not inherently maintained in position to grade parallel to the horizon plane.

U.S. Pat. No. 5,511,326 shows a ditcher which has a parallelogram-like linkage connecting the ditcher blade to the tractor. However, all the members of the parallelogram are not rigid. One member is an hydraulic cylinder which does not permit maintaining the lower surface of the blade in the horizontal plane because the movements in the hydraulic cylinder changes its length and destroys the normal functioning of the parallelogram.

What is needed in this field to overcome these disadvantages is a system that permits level grading with a box blade without constant controlling and without the need for wheels on the rear of the box blade which restricts the usefulness of the system.

SUMMARY

It is an object of the present invention to provide a hitching system for a tractor, in which a movable, vertical hitch member remains vertically position despite the lowering or raising of the blade.

It is an object of the present invention to provide for movement of the movable vertical hitch member only in the vertical direction.

It is a object of the present invention to provide a hitching system for a box blade which maintains the lower surface of the box blade generally in the horizontal plane despite movement of the blade up or down during the grading operation.

It is an object of the present invention to provide a means for inserting a box blade or similar blade into a space that is blocked because it is too narrow for the tractor to enter or because there is a low obstruction, such as a wall or a hedge, which cannot be reached by tractors with conventional hitching systems.

It is an object of the present invention to automatically raise and lower the blade for grading by means of a laser leveling system while maintaining a constant pitch angle on the blade.

The present invention is a hitching system designed to connect an earth moving blade to a vehicle such as a tractor. The hitching system includes a parallelogram arrangement of four shaft-like, rigid members in which each member has a longitudinal axis and each member is typically cut from heavy plate, as for example one-half inch thick steel plate. The four rigid members are connected together at the corners of the parallelogram by means of four rotary joints a first member of the parallelogram is connected to the vehicle and secured with its longitudinal axis held in a vertical position. A second member of the parallelogram, located opposite the first member, is also held with its longitudinal axis in the vertical position by virtue of its location in the parallelogram opposite the first rigid member, but unlike the first rigid member, which is held fixed in its position because of its fixed connection to the vehicle, the second rigid member is free to move in the vertical direction with respect to the vehicle.

The second rigid member is connected to the earth moving blade with the lower surface of the blade positioned in the horizontal plane, which is orthogonal to the longitudinal axis of the second rigid member. This position of the lower surface of the blade is maintained in the horizontal plane despite changes in the height of the blade in the vertical direction which are usually necessary to effectively grade a surface. This is not the case with conventional hitching systems where the lower surface of the blade is unintentionally pitched at an angle with respect to the horizontal plane when the blade is moved in the vertical direction. The elimination of this unintentional pitching of the blade greatly simplifies the grading operation.

DETAILED DESCRIPTION OF THE INVENTION

Figure 1:
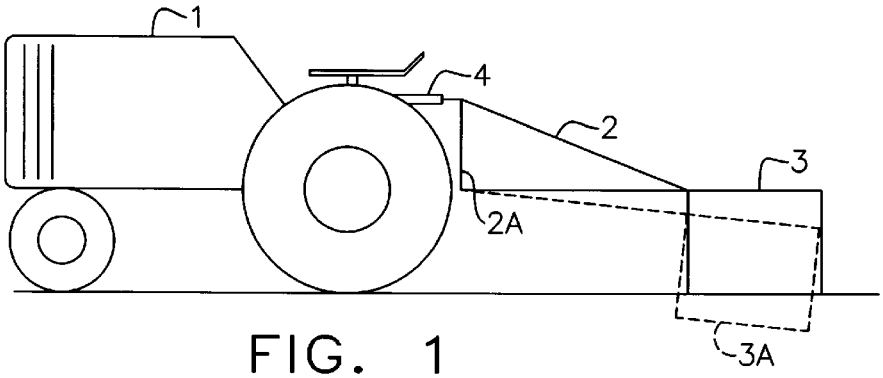
FIG. 1 PRIOR ART
FIG. 1 is a prior art box blade hitching system using a three point hitch which is connected to the box blade and uses an hydraulic cylinder to move the blade.
Figure 2:
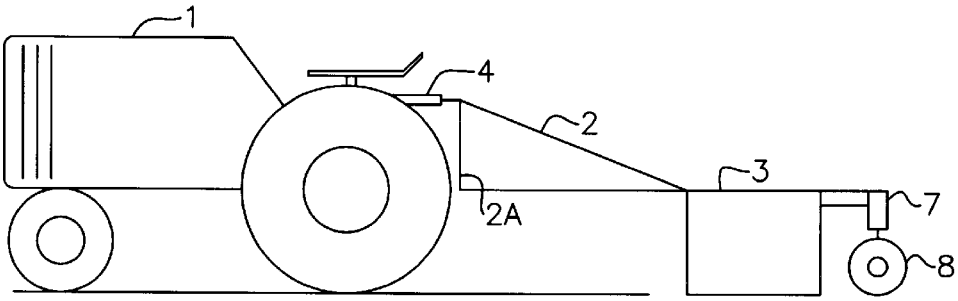
FIG. 2 PRIOR ART
FIG. 2 is a prior art box blade hitching system using a set of wheels to support the rear of the box blade and includes a separate hydraulic cylinder to raise and lower the box blade wheels with respect to the box blade, thereby raising and lowering the box blade itself with respect to the surface of the terrain.
Figure 3:
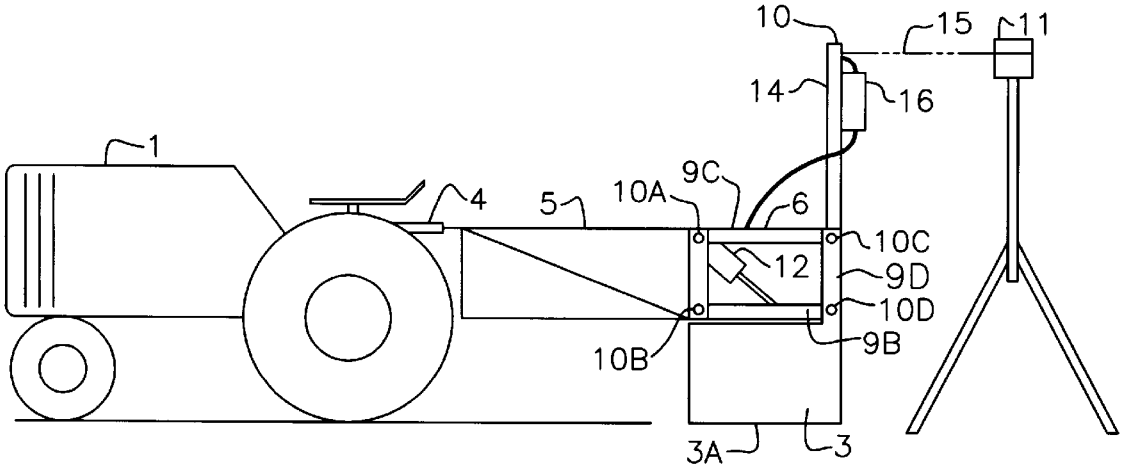
FIG. 3 shows the present invention which includes a parallelogram hitching system in which a movable parallelogram member is maintained in a vertical position. The movable vertical member holds the lower surface of the box blade parallel to the horizontal plane, regardless of the vertical movement of the box blade.

A prime objective of the present invention is to reduce the degree of manual control required to level terrain by maintaining the lower surface of a box blade generally parallel to the horizontal plane despite movement over unlevel terrain and despite the adjustment of the blade in the vertical direction. This objective is achieved in the present invention by using a parallelogram structure in the hitch between the blade and the tractor. This parallelogram 6 is shown in FIG. 3 and consists of four members 9A through 9D. Each of the members is typically a steel arm which is attached at its end to the adjacent members by rotating joints 10A through 10D. In FIG. 3, the members 9A through 9D are shown to be of equal length and are positioned to form a square at one setting of the hitch controls. In this position of the parallelogram, there are two rigid members that form the horizontal sides and two that form the vertical sides.

Member 9A is a vertical member attached to the tractor while member 9D is also a vertical member but is located at the opposite side of the parallelogram. Member 9D is also free to move, but only in the vertical direction generally parallel to member 9A, which is held vertically by virtue of its attachment to the tractor. The lower end of member 9D is connected to the box blade, thereby causing the lower surface of the box blade to be held horizontally regardless of whether the blade is raised or lowered. This feature of the present invention overcomes the prior art problem of incurring unintentional pitching of the blade while the blade is moved to a desired height and consequently greatly reduces the need to constantly adjust the controls during a grading operation.

Although it is usually desired to hold the lower surface of the blade in the horizontal plane, in some cases it is desired to intentionally pitch the blade at a controlled small angle, alpha, with respect to the horizontal plane. Two ways in which this can be accomplished are shown in FIGS. 5 and 6.

Figure 5:
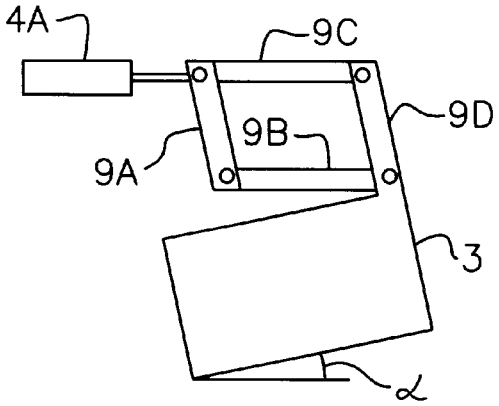
FIG. 5 is a parallelogram hitching system in which a first member of the parallelogram is rotatably attached to a vehicle to enable the first member of the parallelogram hitching system to be set at a small angle with respect to the vertical axis and to set the lower surface of the blade at the same small angle with respect to the horizontal plane.

In FIG. 5, a rigid member, such as member 9A, is rotatably connected at a point, such as the center of rotary joint 10B, to the vehicle. An end of this rigid member that is away from the rotary joint, such as the top end of member 9A, is moved by an hydraulic cylinder 4A, which is connected between this end and the tractor, to offset member 9A from the vertical axis by a small angle alpha. This causes member 9D to be similarly offset from the vertical axis by the angle alpha and the lower surface of the blade to be pitched by the same small angle alpha with respect to the horizontal plane. The parallelogram constrains member 9D to remain offset from the vertical by this small angle despite movement of this member and the movement of the blade in the vertical direction to adjust the height of the blade.

Figure 6:
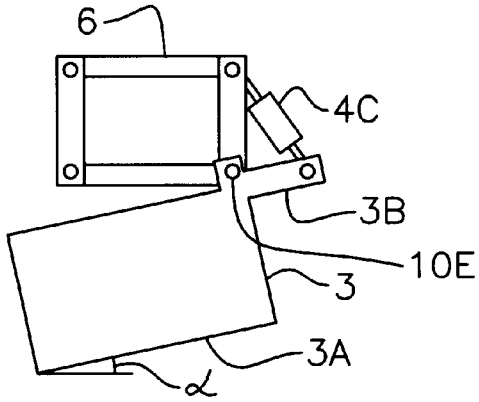
FIG. 6 is a parallelogram hitching system in which the blade is rotatably connected to a second member of the parallelogram by means of a rotary joint to enable the lower surface of the blade to be set at a desired angle with respect to the horizontal plane.

The second method of adjusting the pitch of the lower surface of the blade is shown in FIG. 6. In this Figure, the blade is rotatably attached to member 9D by means of rotary joint 10E. The pitch is set by means of hydraulic cylinder 4C, which is connected between the second rigid member 9D and the blade 3. Since member 9D is usually constrained to remain vertical, the lower surface of the blade will remain set at an angle alpha despite vertical movement of the member 9D to adjust the height of the blade above the terrain.

Note that, although member 9D may be set at a small angle with respect to the vertical axis, its movement is essentially vertical because it is attached to the ends of members 9B and 9C which are extending generally horizontally. Members 9B and 9C rotate about fixed positions at there left end, as shown in FIG. 6, and their right ends can only move in arcs of circles with the center of the arcs located at their left ends. The tangent to these circular arcs at the point where these horizontal members 9B and 9C meet vertical member 9D is in the vertical direction, causing the movement of member 9D to be essentially vertical for the typically small blade movements of a few inches needed to grade.

A number of variations of the parallelogram are permissible without departing from the spirit and scope of the invention. For example, the same results can be achieved if the vertical members are of equal length and the horizontal members are of equal length, but the vertical members are not equal in length to the horizontal members. The sides of the parallelogram need not form a square, as long as opposite sides are parallel. Hydraulic cylinders are the most popular devices currently used to actuate component members of a hitching system, however they are not the only types of devices that can be used. Many different devices that constitute equivalents can be substituted, as for example an electrically or hydraulically driven mechanical worm gear or other reduction gear system. The point of connection of the hydraulic cylinder used to raise and lower the blade can be varied. For example the blade can be raised and lowered by connecting the hydraulic cylinder between the tractor and either the second or the third rigid member of the parallelogram. Twin parallelograms may be uses side by side with one supporting one side of the blade and the other supporting the opposite side of the blade. Other variations which also remain within the spirit and scope of the invention will be readily apparent to those skilled in the art.

As noted above in the section on prior art, one of the difficulties encountered with a prior art arrangement was the location of wheels at the rear of the box blade which prevents the blade from coming close to a wall or other structure to complete a leveling operation. This does not present a problem for the present invention because there are no wheels employed at the rear of the box blade. However, there are areas which cannot be readily reached even with a box blade without wheels because of being blocked by an obstruction or blocked by the narrowness of an area which prevents the tractor from backing into such an area safely. This can be overcome with a variation of the present invention shown in FIG. 4.

Figure 4:
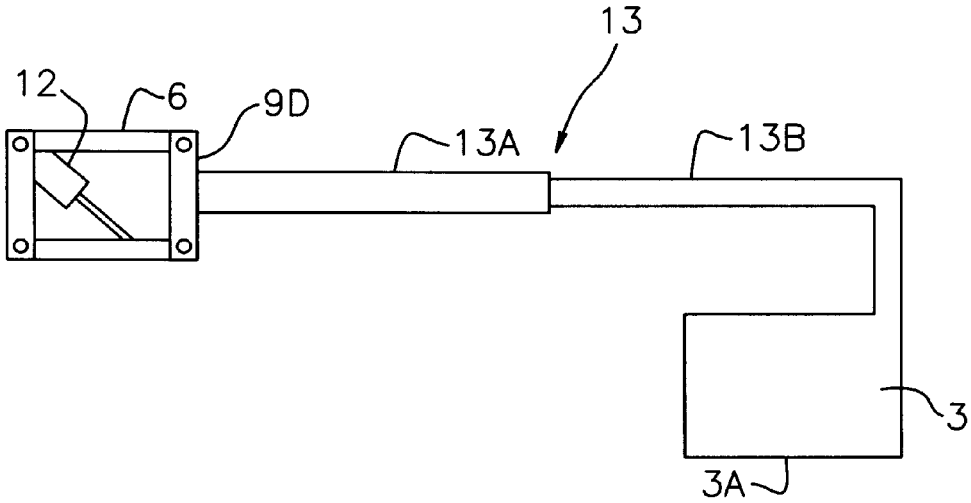
FIG. 4 shows a variation of the present invention which includes a boom used to extend the box blade away from the tractor and into areas that could not ordinarily be reached by the tractor with a conventional hitch.

In FIG. 4, the parallelogram hitching system is not directly connected to box blade, but is connected to the blade via a boom 13. The boom is formed of a first boom section 13A and a second boom section 13B. The two sections of the boom allow the second section to slide within the first so that the boom can be locked at a desired length selected by the operator. The first section of the boom 13A is connected to the vertical member 9D of the parallelogram hitch while the box blade is connected to the far end of the second section of the boom 13B. Since here is a rigid connection between the movable vertical member of the parallelogram and the box blade, the lower surface of the box blade 3A will be maintained parallel to the horizontal plane and will gain all the benefits of this position even though it is located at the end of the boom. Grading can now be accomplished in areas that were previously inaccessible and can be done with much less difficulty. It is now possible with this embodiment of the invention to pass the boom over low obstructions, such as low walls or hedges, or place the boom in areas that are too narrow for the tractor to enter.

The boom may be fabricated in several different ways and still accomplish the same results. For example the boom may be a single member or multiple members that fit within one another or slide past one another. The length of the boom may be adjusted from the tractor by means of an hydraulic cylinder connected between the sections of the boom. A collapsable, or multisection boom allows the boom to be drawn in towards the tractor for normal grading or extended for difficult to reach work. In this arrangement where the boom allows the blade to be drawn in close to the tractor for normal grading, the boom can remain connected to the tractor for all grading operations.

A laser system is combined with the present invention to automatically and accurately produce a level grade. One embodiment of this system is shown in FIG. 3. In this Figure, a laser source generator 11 produces a beam which may be directed at the tractor or which rotate in a horizontal plane and strikes the tractor cyclically. This beam strikes a receiver 10 located on a vertical extension 14 of vertical member 9D. The receiver detects whether its position in a horizontal plane lies above or below the beam and sends a signal to a computer 16 which sends a control signal to the hydraulic cylinder 12 to adjust the height of the box blade to keep the receiver nominally at the beam level and consequently the box blade at the desired height to produce a level grade parallel to the horizontal plane.

Having described my invention, I claim:

1. A hitching system connected between a vehicle and a blade used for earth moving, said hitching system comprising:

(a) four rigid members which are referred to as the first through forth rigid members, each of said rigid members having a longitudinal axis and extending along said longitudinal axis an amount greater than each extends in width or in depth and said rigid members being positioned to form a parallelogram with each of said rigid members forming one of the four sides of said parallelogram, said parallelogram having four corners, each corner being formed by the intersection of the ends of two of said rigid members, said intersection of the ends of two of said rigid members forming an angle of intersection between said two ends, and said parallelogram having opposite sides of generally equal length, (b) four rotary joints, each joint connecting two of said four rigid members at one of said four corners of said parallelogram to enable each rigid member to rotate about two of said joints while remaining rotatably connected at the ends of each rigid member to the adjacent rigid members, said rotation of said rigid member about said rotary joints causing the angle of intersection between rigid members to vary, but despite said rotation, said rigid members remain in a parallelogram configuration, (c) means for connecting the first rigid members to said vehicle, and (d) means for connecting said blade to the second rigid member which is located opposite and positioned parallel to the first rigid member in said parallelogram, and wherein said first rigid member is primarily positioned generally vertically and held in this position by means of its connection to said vehicle, the third and forth rigid members being positioned generally horizontally, and the second rigid member being oriented generally vertically and being restricted to movement generally in the vertical direction by virtue of said four rotary joints and the position of the second rigid member opposite the first rigid member in said parallelogram, said blade is oriented and moved generally by the movements of the second rigid member to which it is connected, the movement of said blade being in a generally vertical direction in accordance with the movement of the second rigid member, and said blade having a lower surface, said lower surface of said blade being oriented generally in the horizontal plane by means of a generally orthogonal positioning of said lower surface of said blade with respect to the longitudinal axis of said second rigid member produced by the connection between said blade and the second rigid member, said lower surface of said blade remaining generally in the horizontal plane despite movement of the second rigid member by virtue of the generally vertical position maintained by said second rigid member and the restriction of movement of this member generally to the vertical direction, said lower surface of the blade being capable of being pitched at a small angle of typically less than 20 degrees with respect to the horizontal plane by pitching the first of said rigid members at a generally identical small angle with respect to the vertical axis, the pitching of the first rigid member being transmitted through the parallelogram to the second rigid member, which remains parallel to the first rigid member, and then to the blade and its lower surface, the lower surface of the blade remaining at said small pitch angle to which it is set despite movements in a generally vertical direction of said second rigid member.

2. A hitching system as claimed in claim 1 wherein said means for connection said blade to said second rigid member includes a boom which is rigidly connected to said second rigid member at one end and to said blade at the other end, said boom extending away from said vehicle and supporting said blade to enable said blade to be extended into areas that are blocked for entrance by said vehicle, said boom having a longitudinal axis and comprising at least a first and a second portion, said first and second portion of said boom dividing said boom in a direction orthogonal to said longitudinal axis of said boom and said first and second portions of said boom overlapping and being slideable attached to one another to enable said boom to be expanded or contracted along the longitudinal axis of said boom.

3. A hitching system as claimed in claim 2 wherein said first portion of said boom is hollow along its longitudinal axis and said second portion is at least partially contained within the hollow of said first portion.

4. A hitching system as claimed in claim 2 further including a first hydraulic cylinder having a first and second end and being attached at its first end to the first portion of said boom and at the second end to the second portion of said boom, the actuation of said hydraulic cylinder producing the drawing in and extending outward of said second portion of said boom from said first portion.

5. A hitching system as claimed in claim 1 further comprising a second hydraulic cylinder, said second hydraulic cylinder having a first and a second end, and said second hydraulic cylinder being connected at its first end to said vehicle and at its second end to the second member, actuation of said second hydraulic cylinder causing said first and second ends of said second hydraulic cylinder to draw in towards one another and extend outwardly and away from one another, said actuation of said second hydraulic cylinder causing the raising and lowering of said second member and the box blade which is connected to said second rigid member.

6. A hitching system connected between a vehicle and a blade used for earth moving, said hitching system comprising:

(a) four rigid members which are referred to as the first through forth rigid members, each of said rigid members having a longitudinal axis and extending along said longitudinal axis an amount greater than each extends in width or in depth and said rigid members being positioned to form a parallelogram with each of said rigid members forming one of the four sides of said parallelogram, said parallelogram having four corners, each corner being formed by the intersection of the ends of two of said rigid members, said intersection of the ends of two of said rigid members forming an angle of intersection between said two ends, and said parallelogram having opposite sides of generally equal length, (b) four rotary joints, each joint connecting two of said four rigid members at one of said four corners of said parallelogram to enable each rigid member to rotate about two of said joints while remaining rotatably connected at the ends of each rigid member to the adjacent rigid members, said rotation of said rigid member about said rotary joints causing the angle of intersection between rigid members to vary, but despite said rotation, said rigid members remain in a parallelogram configuration, (c) means for connecting the first rigid members to said vehicle, and (d) means for connecting said blade to the second rigid member which is located opposite and positioned parallel to the first rigid member in said parallelogram, and wherein said first rigid member is primarily positioned generally vertically and held in this position by means of its connection to said vehicle, the third and forth rigid members being positioned generally horizontally, and the second rigid member being oriented generally vertically and being restricted to movement generally in the vertical direction by virtue of said four rotary joints and the position of the second rigid member opposite the first rigid member in said parallelogram, said blade is oriented and moved generally by the movements of the second rigid member to which it is connected, the movement of said blade being in a generally vertical direction in accordance with the movement of the second rigid member, and said blade having a lower surface, said lower surface of said blade being oriented generally in the horizontal plane by means of a generally orthogonal positioning of said lower surface of said blade with respect to the longitudinal axis of said second rigid member produced by the connection between said blade and the second rigid member, said lower surface of said box blade remaining generally in the horizontal plane despite movement of the second rigid member by virtue of the generally vertical position maintained by said second rigid member and the restriction of movement of this member generally to the vertical direction, (e) a fifth rotary joint connecting said blade to said second rigid member to enable said lower surface of said blade to be pitched at a small angle of less than 20 degrees with the horizontal plane, and (f) a third hydraulic cylinder having a first and a second end, the first end of said third hydraulic cylinder being rotatably connected to said second rigid member at a first point which is away from fifth rotary joint and the second end of said third hydraulic cylinder being connected to said blade at a second point which is away from said fifth rotary joint, said third hydraulic cylinder being actuated to position said bottom surface of said blade at said small angle with the horizontal plane.

* * * * *